US005150418A

United States Patent [19]

Honda et al.

[11] Patent Number: 5,150,418

[45] Date of Patent: Sep. 22, 1992

[54] SPEAKER SYSTEM

[75] Inventors: Kazuki Honda, Katano; Hiroyuki Takewa, Kaizuka; Shuji Saiki, Uda; Kazue Satoh, Neyagawa, all of Japan

[73] Assignee: Matsushita Electric Industrial Co., Ltd., Osaka, Japan

[21] Appl. No.: 688,427

[22] Filed: Apr. 22, 1991

[30] Foreign Application Priority Data

Apr. 20, 1990 [JP] Japan ..... 2-106167
Apr. 20, 1990 [JP] Japan ..... 2-129609

[51] Int. Cl.[5] ..... H04R 25/00

[52] U.S. Cl. ..... 381/159; 381/188; 381/154; 181/148; 181/156

[58] Field of Search ..... 381/159, 188, 154, 88, 381/90, 205; 181/148, 156, 160, 145

[56] References Cited

U.S. PATENT DOCUMENTS

| | | | |
|---|---|---|---|
| 4,284,166 | 8/1981 | Gale | 181/156 |
| 4,618,025 | 10/1986 | Sherman | 181/156 |
| 4,899,390 | 2/1990 | Takewa et al. | 381/159 |
| 4,944,019 | 7/1990 | Watanabe | 381/188 |
| 5,044,066 | 4/1991 | Furukawa | 381/159 |

*Primary Examiner*—Jin F. Ng
*Assistant Examiner*—Huyen Le
*Attorney, Agent, or Firm*—Wenderoth, Lind & Ponack

[57] ABSTRACT

In a speaker system, the rearward area of a diaphragm is separated into two acoustic regions. One of the two acoustic regions is a rear opening type and the other is a base-reflex type. An acoustic mass, such as a port or a passive radiator, is located between the first and second acoustic regions for providing a phase inversion characteristic.

2 Claims, 5 Drawing Sheets

SPEAKER SYSTEM

BACKGROUND OF THE INVENTION

1. Field of the Invention

The present invention relates to a speaker system, and more particularly, to a thin-type speaker for the reproduction of deep bass sounds.

2. Description of the Prior Art

It is commonly desired that audio apparatus be compact and of a small depth to minimize space requirements, and yet be capable of reproducing high-fidelity sounds.

However, conventional speaker systems produce deep bass sounds using a relatively large diaphragm and an enclosure of substantial dimensions.

The inventors of the present invention have developed a novel speaker system having a diaphragm installed in a combination enclosure of a fully enclosed cabinet structure and a rear opening cabinet arrangement. Such a speaker system will be described with reference to FIGS. 6(*a*), 6(*b*) and 7. FIG. 6(*a*) illustrates a plan view of the speaker system and FIG. 6(*b*) illustrates a cross sectional view taken along the line 20-20 of FIG. 6(*a*). (FIG. 6(*a*) does not depict a diaphragm for simplicity purposes.) As shown, reference numeral 1 denotes a diaphragm which is mounted by an edge member 2 to an enclosure 3 and which is activated by voice coils 5 installed in the magnetic gap of a magnetic circuit 4. An enclosed cabinet region 6 is provided behind the outer peripheral portion 1*a* of the diaphragm 1. The minimum resonant frequency $f_O$ of the system is thus determined by the weight M of a vibrating system and the stiffness $S_B$ of the enclosed cabinet region 6 and is expressed as:

$$f_0 = \frac{1}{2\pi} \sqrt{S_B/M}$$

Behind the central area 1*b* of the diaphragm 1, a rear opening cabinet region is formed by a center plate 7, an inner edge 8, and ducts 9 and 10, the rear opening cabinet region being separated from the enclosed cabinet region 6.

The operation of the speaker system having the foregoing arrangement will now be explained.

FIG. 7 is a frequency characteristic diagram associated with the speaker system activated in an anechoic room. The overall sound pressure equals a sum of a sound pressure in the enclosed region and a sound pressure in the rear opening region. At the enclosed region, a corresponding area of the diaphragm is lessened by an extension of the opening region and thus $f_O$ becomes relatively low and is advantageous for the reproduction of a bass sound. However, the reduced diaphragm area causes a mid-range sound to be reproduced to a lesser extent. At the opening region, a phase-inverted sound emitted from the back of the diaphragm is propagated across the ducts to the rear of the enclosure. The rear sound is diffracted to the front and mixed with the direct sound emitted from the front of the speaker system. When the distance from the rear to the front is small, the phase difference between the front and rear sounds becomes small, particularly in the low frequency range, and thus a low frequency component of the reproduced sound will be diminished. On the other hand, a middle range component of the sound is not affected and will thus be relatively increased in sound pressure. Accordingly, the speaker system having both the enclosed type and opening type cabinet arrangements can produce a better sound, which is flat in a wide range of frequencies and high in acoustic pressure, with the enclosed cabinet arrangement enhancing the bass sound and the opening cabinet arrangement enhancing the mid-range sound.

The drawback of the foregoing speaker system is that when it is placed close to the rear wall of a room, most of the rearward sound emitted from the rear opening is reflected on the rear room wall towards the front of the speaker system. This results in an offsetting of bass components of the front sound with the same of the rear sound and thus the reproduced sound will be diminished in the bass range.

SUMMARY OF THE INVENTION

It is an object of the present invention to provide an improved speaker system capable of the reproduction of quality bass sound regardless of installation conditions.

A first arrangement according to the present invention is provided having a bass-reflex cabinet region in place of the conventional closed region. Also, the acoustic exit of the bass-reflex cabinet region is arranged to approximately coincide with the acoustic exit of an opening cabinet region so that two sound components respectively emitted from the bass-reflex and opening cabinet regions can be combined to a nearly perfect composite sound prior to rearward emission. The two sound components which are reverse in the phase to each other tend to offset each other, thus decreasing in the sound pressure. This composite rear sound is then propagated frontward and tends to lower the sound pressure of a bass range through offsetting action with the front sound. The sound pressure of the rear sound is attenuated as compared with that of the prior art and a decrease in the bass range resulting from the interaction of offsetting will be minimized.

A second arrangement of the present invention is provided in which a rearward space behind a diaphragm is separated into at least two acoustic regions. At least one of the acoustic regions is a closed space and the other acoustic regions are communicated with corresponding acoustic tubes which are different in tube length from each other. Accordingly, by varying the tube length of each acoustic tube across which a portion of the rear sound emitted from the back of the diaphragm is propagated to the rearward of the speaker system, the rear sound is time delayed for control of the wavelength. Hence, attenuation in the sound level resulting from an acoustic offsetting action will be minimized and the sound pressure of a reproduced sound will be increased by phase matching.

As the result, a speaker system capable of the reproduction of quality bass sound without concern of the installation conditions becomes feasible.

DESCRIPTION OF THE PREFERRED EMBODIMENTS

Figure 1:
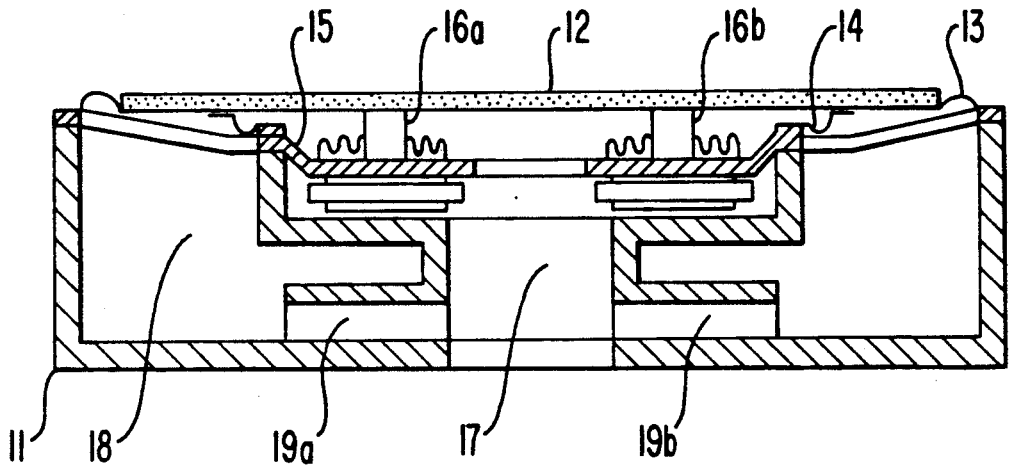
FIG. 1 is a cross sectional view of a speaker system according to a first embodiment of the present invention.

FIG. 1 is a cross sectional view of a speaker system according to a first embodiment of the present invention. Illustrated are an enclosure 11, a diaphragm 12, an edge member 13, an inner edge member 14, a frame 15, a pair of voice coils 16*a* and 16*b*, a rear enclosure opening 17 which serves as a first cabinet region, a bass-reflex enclosure chamber 18 which serves as a second cabinet region, and a pair of ports 19*a* and 19*b*. The edge member 13 is fixedly coupled at its outer periphery to the frame 15 and at its inner periphery to the diaphragm 12. The inner edge member 14 is fixedly coupled at its one end to an intermediate area of the diaphragm 12 (between the outer periphery of the diaphragm 12 and the proximal area of the diaphragm 12 to which the voice coils 16*a* and 16*b* are secured) and at its other end to the frame 15. The rear enclosure opening 17 is defined by the diaphragm 12, the inner edge member 14, and the inner wall of the enclosure 11. Also, the bass-reflex enclosure chamber 18 is defined by the diaphragm 12, the edge member 13, the inner edge member 14, and the inner wall of the enclosure 11. The two ports 19*a* and 19*b* are provided in a partition between the rear enclosure opening 17 and the bass-reflex enclosure chamber 18.

The operation of the speaker system having the foregoing arrangement will now be described.

Electromotive energy is transmitted from the voice coils 16*a* and 16*b* to the diaphragm 12 which in turn emits sound directly from the front thereof. Sound emitted from the rear of the diaphragm 12 is propagated rearward from the rear enclosure opening 17 and also across the bass-reflex enclosure chamber 18. A portion of the rearward sound propagating the bass-reflex enclosure chamber 18 is resonated by means of the acoustic compliance of the chamber 18 and the acoustic mass of the two ports 19*a* and 19*b*. A resultant phase-inverted sound is then emitted from the ports 19*a* and 19*b*. The remaining of the rearward sound is propagated directly through the rear enclosure opening 17 and then is combined with the phase-inverted sound from the ports 19*a* and 19*b*. Because the rear end of the rear enclosure opening 17 is arranged to approximately coincide with the exit of the ports 19*a* and 19*b* of the bass-reflex enclosure chamber 18, the two sound portions are successfully combined into a composite rearward sound prior to emission from the rear of the speaker system. If the rear end of the rear enclosure opening 18 is spaced a distance form the exit of the ports 19*a* and 19*b*, the two rearward sound portions will hardly be recovered to a composite sound while having been affected by the background of the speaker system. The successful composite rear sound according to the present invention is then propagated from the rear to the front. Therefore, the rear sound which is reversed in the phase to the front sound can be decreased in sound pressure even when the enclosure is of a thin type having a large vibrating area diaphragm and small-sized bass-reflex chamber so that the phase inversion is less effected. More particularly, a composite output of the front and rear sounds can be increased by about 3 dB when the enclosed cabinet region of a conventional speaker system is replaced with a bass-reflex chamber arrangement.

Figure 2:
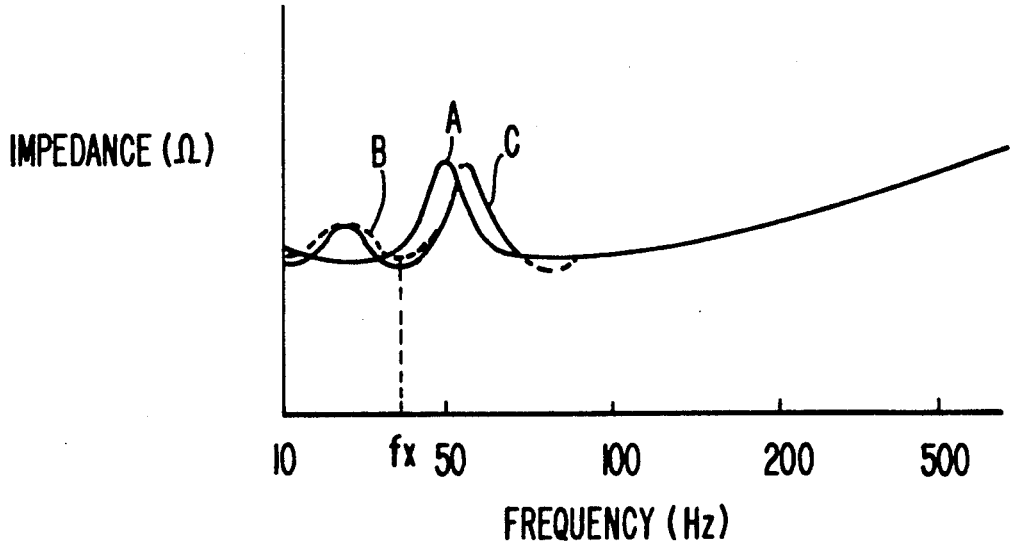
FIG. 2 is an impedance/frequency characteristic diagram.

For minimizing the resonant frequency of the speaker system, the resonant frequency in the bass-reflex chamber should be smaller than the minimum resonant frequency of the conventional speaker system. If so, the amplitude of vibration of the diaphragm 12 remains low at fx of the resonant frequency in the base-reflex chamber and thus unwanted harmonic distortion will be attenuated. Also, for lowering the resonant frequency it is desirable to have the ports 19*a* and 19*b* lengthened to a proper extension. The port arrangement of the present invention is formed in a straight tubular passage extending along the rear wall of the thin-type enclosure so that viscosity resistance is hardly involved as compared with a winding form of port arrangement. As a result, the effect of phase inversion will be enhanced. This particular aspect is portrayed in an impedance/frequency characteristic diagram of FIG. 2 showing three characteristic curves; curve A denotes the prior art, curve B denotes the winding port arrangement, and curve C denotes the straight port arrangement. The ports 19*a* and 19*b* are situated in a partition between the rear enclosure opening 17 and the bass-reflex chamber 18 thus allowing two different outputs from the opening 17 and the chamber 18 to be accurately combined to a composite rearward sound prior to outward emission. Accordingly, the composite rear sound, which has been recovered with no interference from unwanted obstacles including a reflective rear wall behind the speaker system and which is reverse in phase to the front sound, is suppressed in sound pressure and the bass proportion will be relatively increased.

Figure 3:
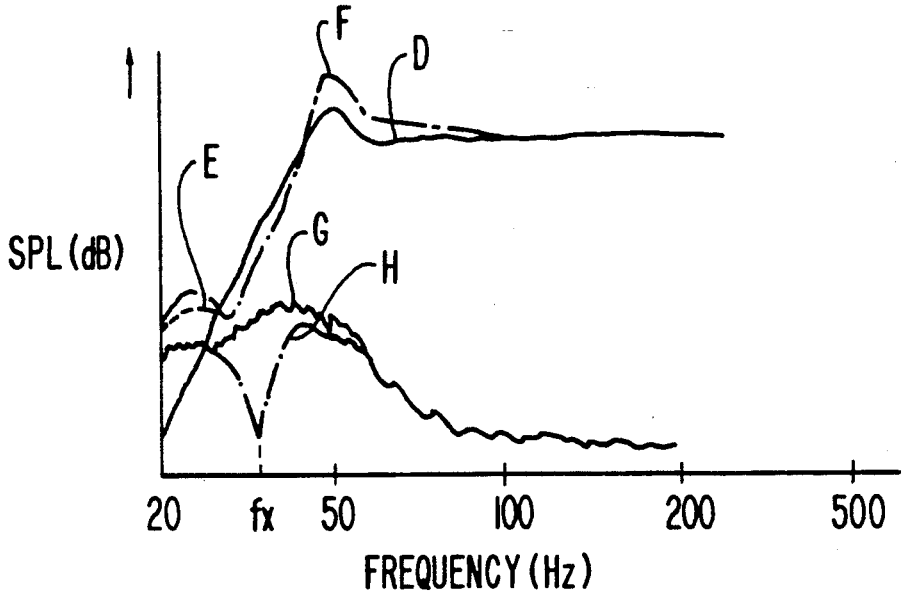
FIG. 3 is a sound pressure/frequency characteristic diagram.

FIG. 3 shows frequency characteristics associated with the prior art and the first embodiment. Represented by curves D, E, and F are sound pressure characteristics of the prior art, the speaker system with the winding port arrangement, and the speaker system with the straight port arrangement, respectively. Denoted by curves G and H are secondary harmonic distortion characteristics of the prior art and the first embodiment, respectively.

Figure 4:
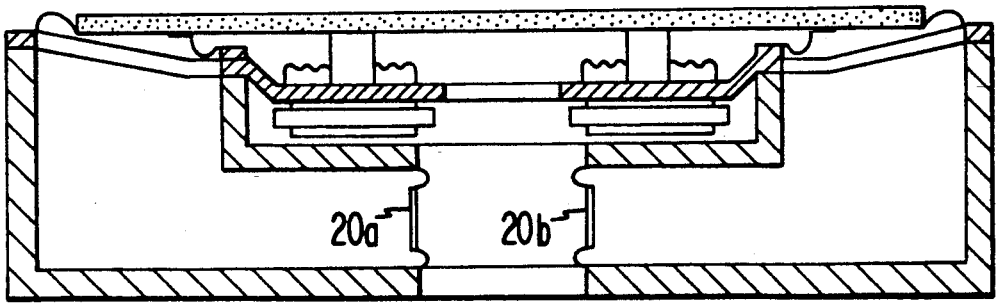
FIG. 4 is a cross sectional view of the first embodiment employing passive radiators.

Although the ports are provided in the bass-reflex chamber for providing a resonant acoustic mass according to the first embodiment, they may be replaced with passive radiators 20*a*, 20*b* for equal success as shown in FIG. 4. Also, the first and second cabinet regions may be changed over. Furthermore, the voice coils are not limited to the number in the described embodiment.

Figure 5A:
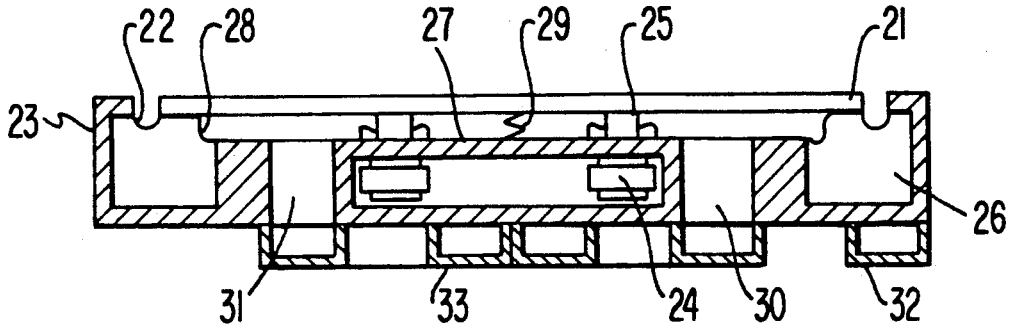
FIGS. 5(*a*) and (*b*) constitute a schematic view of a speaker system according to a second embodiment of the present invention.
Figure 5B:
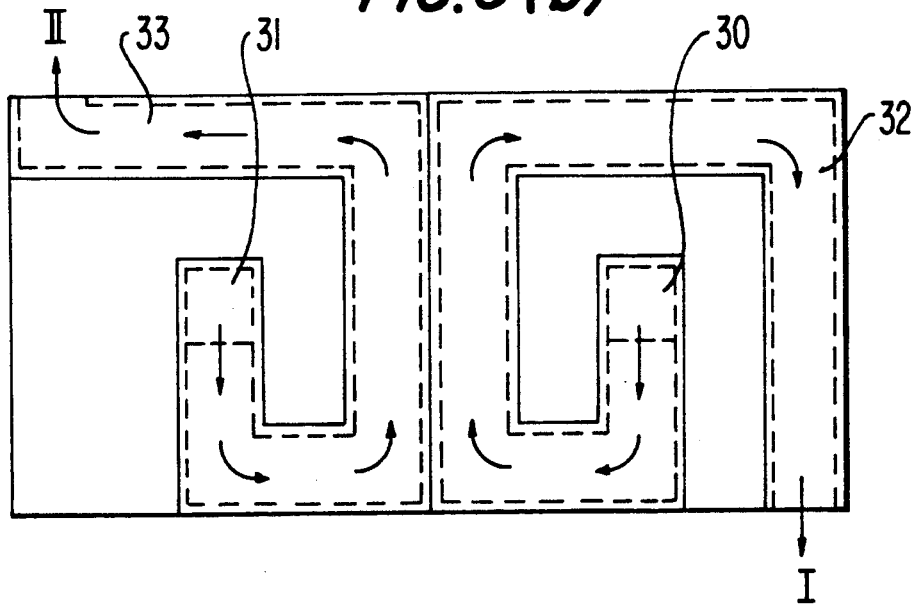

FIG. 5(*a*) is a cross sectional view of a speaker system showing a second embodiment of the present invention and FIG. 5(*b*) is a plan view of the same. As shown, a diaphragm 21 is mounted by an edge member 22 to an enclosure 23 for being activated by voice coils 25 arranged in the magnetic gap of magnetic circuits 24. A closed space 26 is provided behind the outer periphery of the diaphragm 21. The rear central region of the diaphragm 21 is separated from the closed space 26 by a center plate 27, two inner edge members 28 and 29, and a pair of ducts 30 and 31. The two ducts 30 and 31 are communicated with a pair of acoustic tubes 32 and 33, respectively, which are different in extension relative to each other for providing two acoustic passages denoted by the arrows I and II.

Figure 6:
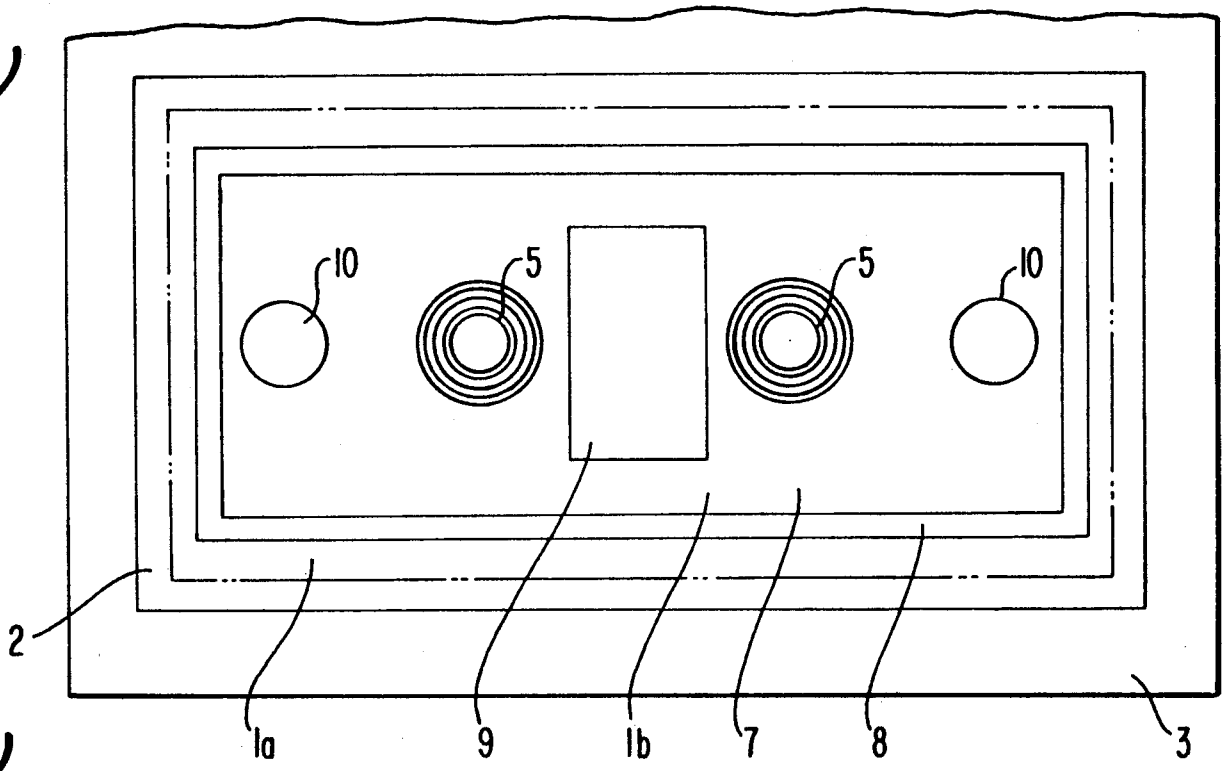
FIG. 6 (a) PRIOR ART
FIGS. 6(*a*) and (*b*) constitute a schematic view of a prior art speaker system.
Figure 6:
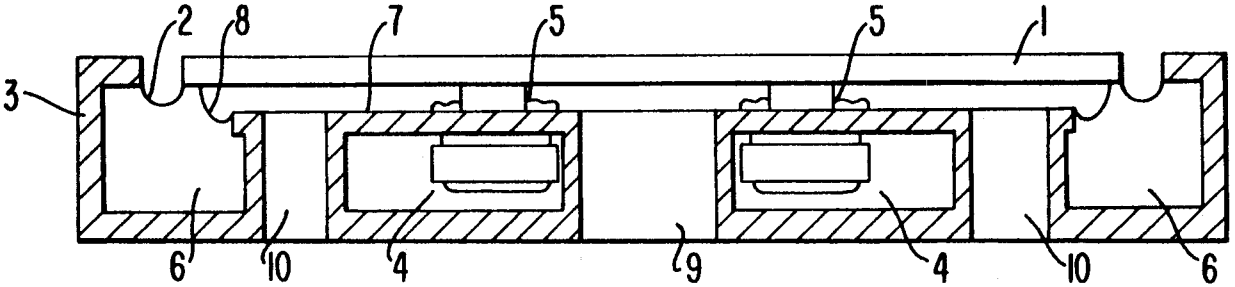
FIG. 6 (b) PRIOR ART
Figure 7:
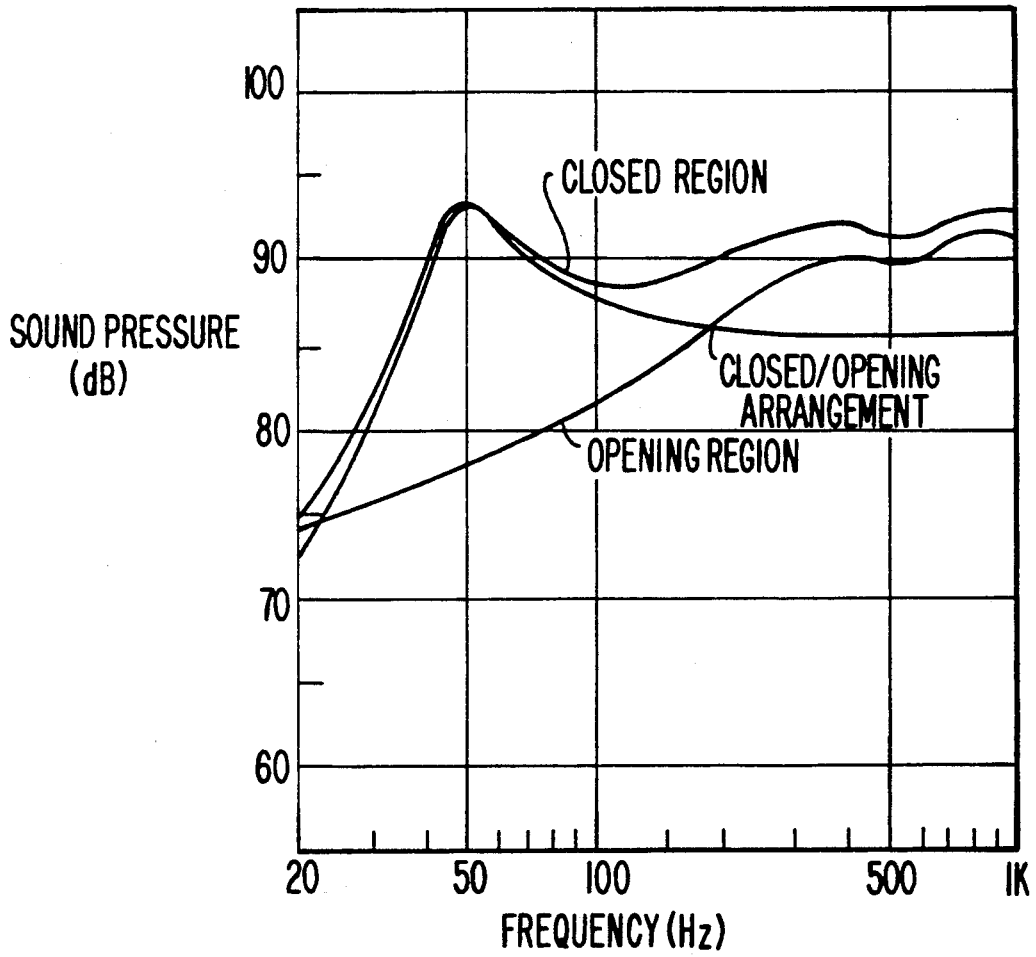
FIG. 7 is a sound pressure/frequency characteristic diagram of the prior art speaker system.

The operation of the speaker system having the foregoing arrangement will be explained. The area behind the diaphragm 21 is separated by the two inner edge members 28 and 29 into three regions; the closed spaced 26, the duct 30, and the duct 31. The ducts 30 and 31 are communicated to their respective acoustic tubes 32 and 33 which have different extensions. In operation, a portion of the sound emitted from the rear of the diaphragm 21 remains in the closed space 26 and the other portion is propagated from the ducts 30 and 31 via the acoustic tubes 32 and 33 to the outside sound field. The reproduced sound from the speaker system, like the prior art shown in FIG. 6, is a composite output of the front sound emitted from the front of the diaphragm 21 and rear sound derived from the back of the diaphragm 21 and emitted from the acoustic tubes 32 and 33. While passing the acoustic tubes 32 and 33, the rear sound from the ducts 30 and 31 is time delayed as compared with the direct front sound. Accordingly, the front and rear sounds which are reverse in phase to each other are prevented from offsetting each other. At frequencies where the length of the acoustic tube is equal to ½ a wavelength of the reproduced sound, the front and rear sounds from the diaphragm 21 are in phase with each other and summed up, thus increasing in the sound pressure. At frequencies where the acoustic tube length is equal to a wavelength of the reproduced sound, the front and rear sounds become reversed in phase to each other and tend to offset each other, thus reducing the sound pressure of the composite sound. For balancing the sound pressure, summing and offsetting effects can be controlled by varying the passage lengths of the acoustic tubes 32 and 33.

Although the space behind of the diaphragm is separated into one closed space and two duct regions in the second embodiment, more duct regions may be provided. The greater the number of duct regions communicated with corresponding acoustic tubes of different length, the more effectively the summing of and offsetting between the front and rear sounds from the diaphragm 21 can be controlled for achieving a flat sound pressure throughout a wide range of frequencies.

We claim:

1. A speaker system comprising:

a frame member;

a diaphragm fixedly mounted by an edge member to said frame member;

an enclosure for securely holding said frame member;

a first acoustic region defined by a rear surface of said diaphragm, said frame member, and an inner edge member extending between said diaphragm and said frame member, said inner edge member for separating a rearward area of said diaphragm into two regions; and a second acoustic region defined by said rear surface of said diaphragm, said edge member, said inner edge member, said frame member, and an inner wall of said enclosure, wherein one of said first and second acoustic regions is a rear opening type and the other is bass-reflex type, further having an acoustic mass between said first and second acoustic regions for providing a phase inversion characteristic.

2. A speaker system according to claim 1, wherein said acoustic mass is a port or a passive radiator.

* * * * *